US008474168B2

(12) United States Patent
Wick

(10) Patent No.: US 8,474,168 B2
(45) Date of Patent: Jul. 2, 2013

(54) ADJUSTABLE SIGN FRAME AND METHOD OF USING THE SAME

(76) Inventor: Melinda Jean Wick, Carol Stream, IL (US)

( * ) Notice: Subject to any disclaimer, the term of this patent is extended or adjusted under 35 U.S.C. 154(b) by 104 days.

(21) Appl. No.: 13/173,361

(22) Filed: Jun. 30, 2011

(65) Prior Publication Data

US 2012/0000106 A1 Jan. 5, 2012

Related U.S. Application Data

(60) Provisional application No. 61/398,739, filed on Jun. 30, 2010.

(51) Int. Cl.
*G09F 7/22* (2006.01)

(52) U.S. Cl.
USPC ..... 40/617; 248/322

(58) Field of Classification Search
USPC ..... 40/617; 248/489, 322, 339, 340
See application file for complete search history.

(56) References Cited

U.S. PATENT DOCUMENTS

| | | | | | |
|---|---|---|---|---|---|
| 1,232,189 | A * | 7/1917 | Bernstein | 40/617 |
| 5,090,145 | A * | 2/1992 | Chiang et al. | 40/605 |
| 5,409,191 | A * | 4/1995 | Wenmaekers | 248/317 |
| 5,499,789 | A * | 3/1996 | Rose | 248/489 |
| 5,806,823 | A * | 9/1998 | Callas | 248/320 |
| 6,305,109 | B1 * | 10/2001 | Lee | 40/546 |
| 6,820,853 | B1 * | 11/2004 | DuBarry | 248/489 |
| 7,213,938 | B2 * | 5/2007 | Brondt et al. | 362/225 |
| 7,673,409 | B2 * | 3/2010 | Pitcher et al. | 40/617 |
| 7,712,239 | B2 * | 5/2010 | Pitcher et al. | 40/617 |
| 8,104,207 | B2 * | 1/2012 | Pitcher et al. | 40/617 |

* cited by examiner

*Primary Examiner* — Joanne Silbermann
*Assistant Examiner* — Kristina Junge
(74) *Attorney, Agent, or Firm* — Justin Lampel

(57) ABSTRACT

An adjustable sign frame and a method of using the same are provided. The adjustable sign frame has a main support rod and an adjustable hanging bar. During use, the main support rod and hanging bar are substantially parallel with respect to one another. Further, the main support rod and hanging bar are substantially identical in length. A plurality of wires may be used to hang the main support rod to the ceiling. A plurality of support clamps attached to the main support rod may temporarily hold the hanging bar which may have a retail sign attached thereto. Pegs on the hanging bar may allow a user to adjust the overall location of the retail sign hanging from the main support rod with respect to the ceiling.

4 Claims, 5 Drawing Sheets

16
2
5
922
500
18
15
51
41
25
28
30
27
26
52
29
31
50
6
55
828
4
35
40
301
200
250
823

ADJUSTABLE SIGN FRAME AND METHOD OF USING THE SAME

REFERENCE TO RELATED APPLICATION

The present application is based on U.S. provisional application No. 61/398,739 filed on Jun. 30, 2010, currently co-pending, the entire contents of which are incorporated by reference. Applicant claims the priority benefit of the 61/398,739 application.

BACKGROUND OF THE INVENTION

An adjustable sign frame and a method of using the same are provided. The adjustable sign frame has a main support rod and an adjustable hanging bar. During use, the main support rod and hanging bar are substantially parallel with respect to one another. Further, the main support rod and hanging bar are substantially identical in length. A plurality of wires may be used to hang the main support rod to the ceiling. A plurality of support clamps attached to the main support rod may temporarily hold the hanging bar which may have a retail sign attached thereto. Pegs on the hanging bar may allow a user to adjust the overall location of the retail sign hanging from the main support rod with respect to the ceiling.

Sign hanging structures have been created over the years. U.S. Pat. No. 6,343,776 to Coon discloses a sign hanging structure having a metal angle iron bar 4, with a flatbar 2 welded to the angle iron bar 4 at point 3 on the top leg 10. The flatbar 2 having a metal dowel 1 welded to the end opposite of point 3. A pad 8 is attached to the end of the angle iron bar 4 and two cylindrical holes are drilled in the downturn leg 9 of the angle iron bar 4 to accommodate two "S" hooks. The outside downturn leg 14 provides additional support and stress accommodation to the end plate 5 and top leg 10.

U.S. Pat. No. 4,250,647 to Woodard discloses an upright standard of non-circular cross section having a lower end for anchoring in the ground and an upper end portion including first and second oppositely facing sides. One of the sides is substantially straight longitudinally of the standard and the other side includes a plurality of abutments spaced therealong and projecting outwardly therefrom. A horizontal support arm is provided and includes base and free ends and the base end defines an upstanding opening formed therethrough. The upper end of the standard is slidingly received through the opening with the free arm end projecting laterally outwardly from the straight standard side. The base end of the arm includes an abutment surface spaced below the opening and toward the base end from the side of the opening adjacent the free arm end and abuttingly engageable with the standard straight side one surface. The arm portions on the side of the opening remote from the free arm end define downwardly facing abutment surfaces for engagement with the abutments and the free arm end includes structure for supporting a vertical sign panel therefrom. When the arm is horizontally disposed, the first mentioned abutment surface abuts the one side of the standard and the downwardly facing abutment surfaces engage a corresponding abutment for support of the arm in adjusted elevated position on the standard and the free end of the arm may be inclined upwardly to enable the base end thereof to be shifted longitudinally of the standard.

However, these adjustable sign frames and methods fail to disclose an adjustable sign frame and method of using the same which is easy to use and for which a user may easily change a sign hanging from a ceiling. A need, therefore, exists for an improved adjustable sign frame and method of using the same.

SUMMARY OF THE INVENTION

An adjustable sign frame and a method of using the same are provided. The adjustable sign frame has a main support rod and an adjustable hanging bar. During use, the main support rod and hanging bar are substantially parallel with respect to one another. Further, the main support rod and hanging bar are substantially identical in length. A plurality of wires may be used to hang the main support rod to the ceiling. A plurality of support clamps attached to the main support rod may temporarily hold the hanging bar which may have a retail sign attached thereto. Pegs on the hanging bar may allow a user to adjust the overall location of the retail sign hanging from the main support rod with respect to the ceiling.

An advantage of the present adjustable sign frame and method of using the same is to provide a device which allows for the easy changing of a retail sign hanging from the ceiling.

A further advantage of the present adjustable sign frame and method of using the same is to provide a frame which may be quickly changed in a retail environment.

An advantage of the present invention is to provide an adjustable sign frame which is stationary and suspended at a height that is easily accessible with an adjustable pole.

Yet another advantage of the present system is to provide an adjustable sign frame and method of using the same wherein a hanging bar of the device has a plurality of pegs which allow for a length of a wire supporting the retail sign to be adjusted.

Still another advantage of the present adjustable sign frame and method of using the same is to provide a frame which allows for the safe changing of a sign without the need for a ladder.

Still another advantage of the device is to provide an adjustable sign frame which may be easily assembled and reassembled.

For a more complete understanding of the above listed features and advantages of the present adjustable sign frame and method of using the same, reference should be made to the following detailed description of the preferred embodiments. Further, additional features and advantages of the invention are described in, and will be apparent from, the detailed description of the preferred embodiments.

DETAILED DESCRIPTION OF THE PREFERRED EMBODIMENTS

Figure 1:
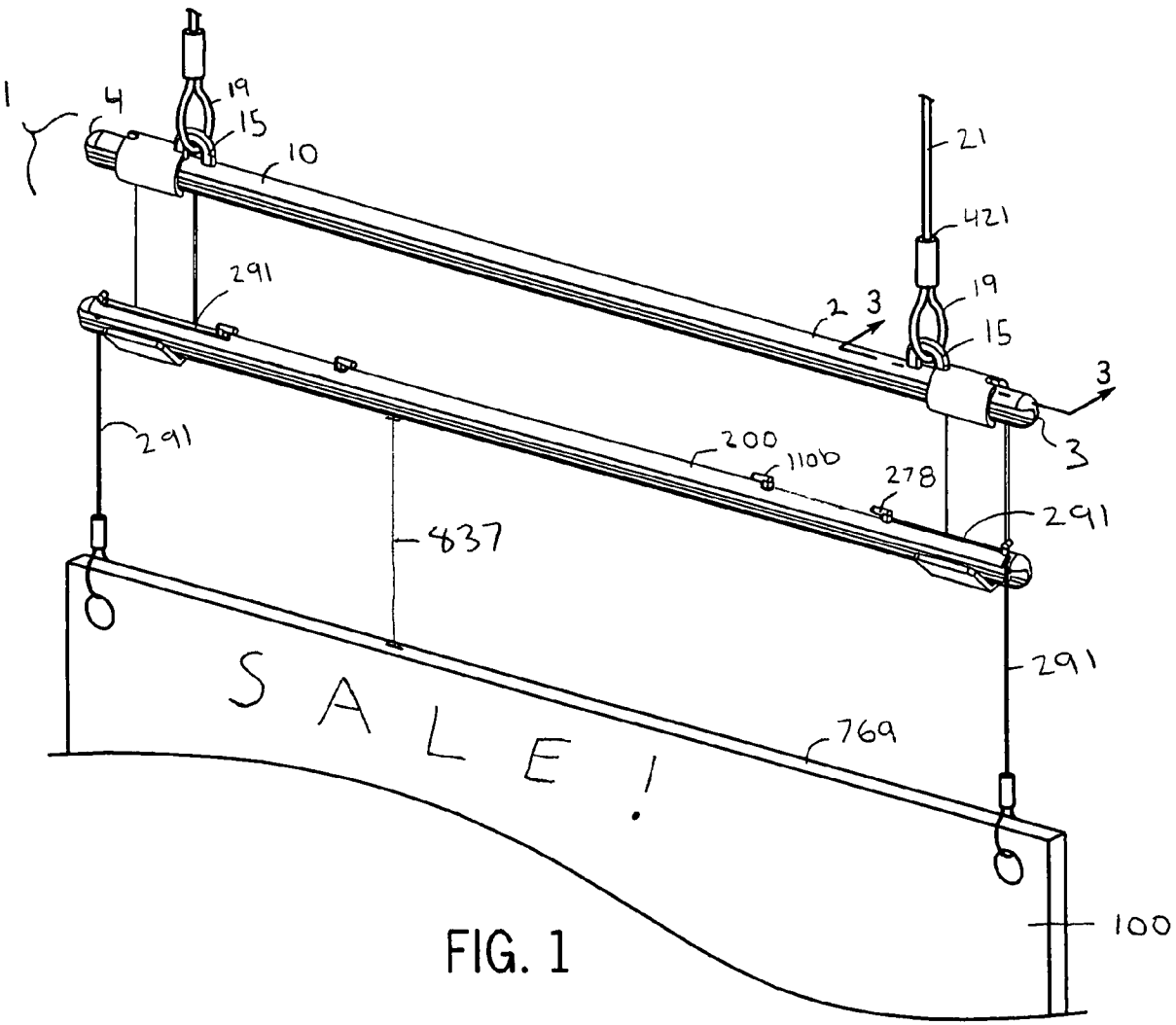
FIG. 1 illustrates a front perspective view of the device with a retail sign hanging from the same.

An adjustable sign frame and a method of using the same are provided. The adjustable sign frame has a main support rod and an adjustable hanging bar. During use, the main support rod and hanging bar are substantially parallel with respect to one another. Further, the main support rod and hanging bar are substantially identical in length. A plurality of wires may be used to hang the main support rod to the ceiling. A plurality of support clamps attached to the main support rod may temporarily hold the hanging bar which may have a retail sign attached thereto. Pegs on the hanging bar may allow a user to adjust the overall location of the retail sign hanging from the main support rod with respect to the ceiling.

The adjustable sign frame 1 has a main support rod 2. The main support rod 2 has a first end 3, a second end 4, and a length 5. In the present figures, the main support rod 2 is illustrated as largely cylindrical having a circumference 6 and a diameter 50; however, it should be noted that the main support rod 2 may be of any suitable shape. Preferably, the main support rod 2 is made of a plastic, metal or another strong material so as the main support rod 2 may support, for example, the weight of a retail sign 100.

Located on an exterior surface 10 of the main support rod 2 may be at least two securing loops 15. The two securing loops 15 may be located near the first end 3 and second end 4 of the main support rod 2. Preferably, the two securing loops 15 are located at a distance 16 apart from each other which is substantially similar to a width of a typical ceiling panel (around 24 inches). As a result, the entire device 1 may more easily be secured to a ceiling 39 (FIG. 6) in a stable manner.

The two securing loops 15 extend outward from the exterior surface 10 of the main support rod 2 along the same planar surface as each other. More specifically, the two securing loops 15 extend outward from the main support rod 2 in a parallel position with respect to one another. In use, the two securing loops 15 are position upward, facing toward the ceiling 39. The two securing loops 15 each have a width 55 (FIG. 2*a*) and further each have an opening 18 for receiving a hanging loop 19. The hanging loop 19 may be located at the second end 421 of a main support wire 21 wherein the main support wire 21 has a first end 420 and a second end 421.

Figures 2A, 2B:
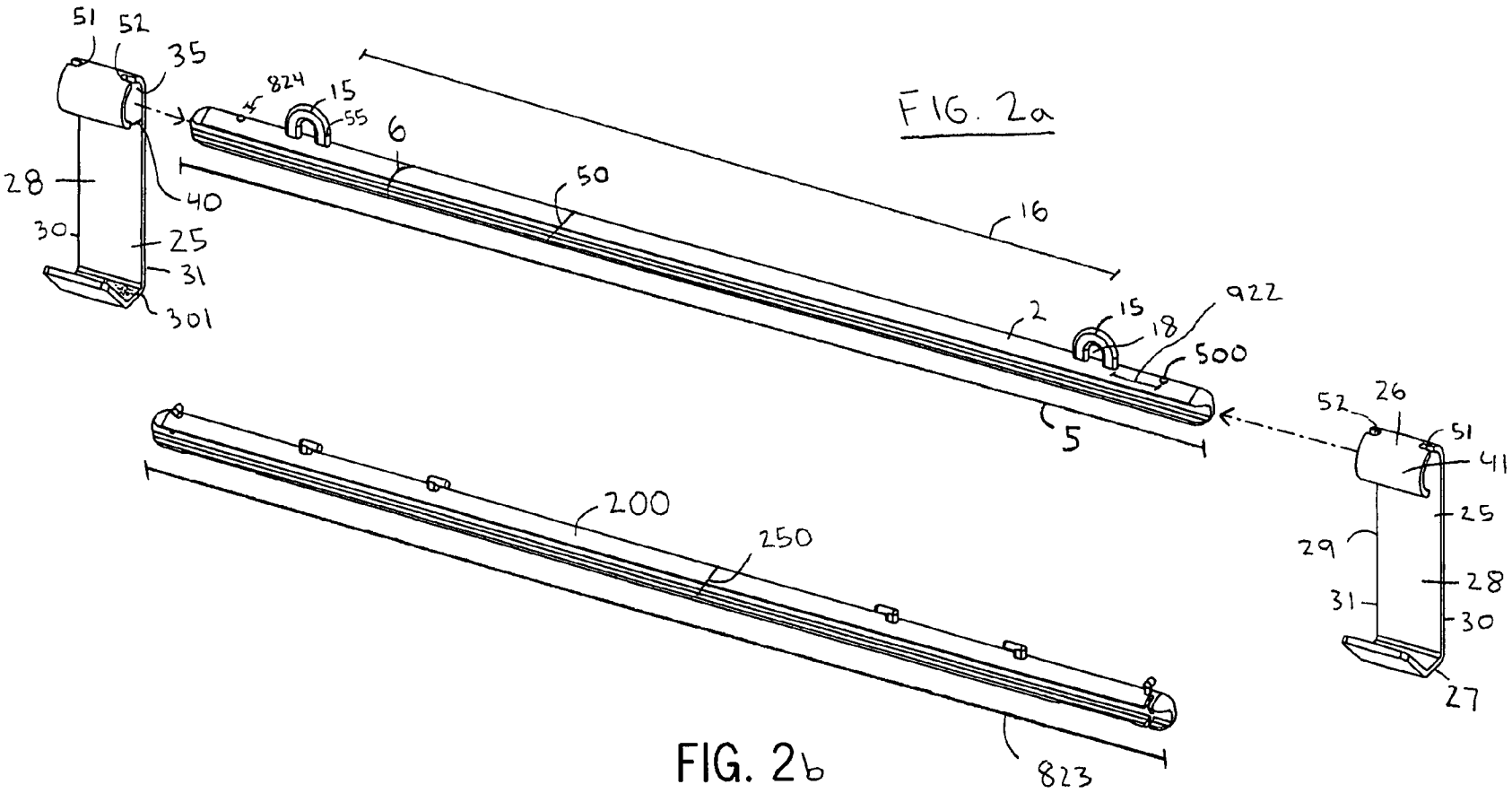
FIG. 2*a* illustrates a front perspective view of the support clamps being inserted on the main support rod.
FIG. 2*b* illustrates a front perspective view of the hanging bar.

Referring now to FIGS. 2*a* and 2*b*, the device 1 may have at least two identical support clamps 25. The two support clamps 25 each have a top 26, a bottom 27, a front 28, a back 29, a first side 30 and a second side 31. The tops 26 of the two support clamps 25 may be curved so that a portion 41 of the clamps 25 curves and extends downward toward the bottom 27 of the support clamps 25. The curved portion 41 of the tops 26 may have an inner wall surface 35 which may have an arch substantially similar in shape to the shape of the circumference 6 of the main support rod 2 such that the two support clamps 25 may rest on and be snugly secured near the ends 3, 4 of the main support rod 2 while in use. More specifically, the two support clamps 25 may slide over the ends 3 and 4 of the main support rod 2 prior to use.

An opening 40 may define a distance between where the curved downward portion 41 curves toward, but does not reach the front 28 of the two support clamps 25. The opening 40 may be less than the diameter 50 of the main support rod 2 such that when the two support clamps 25 are slid over the ends 3 and 4 of the main support rod 2, the two support clamps 25 may only be removed from the main support rod 2 by sliding the two support clamps 25 outward away from the main support rod 2.

Figure 8:
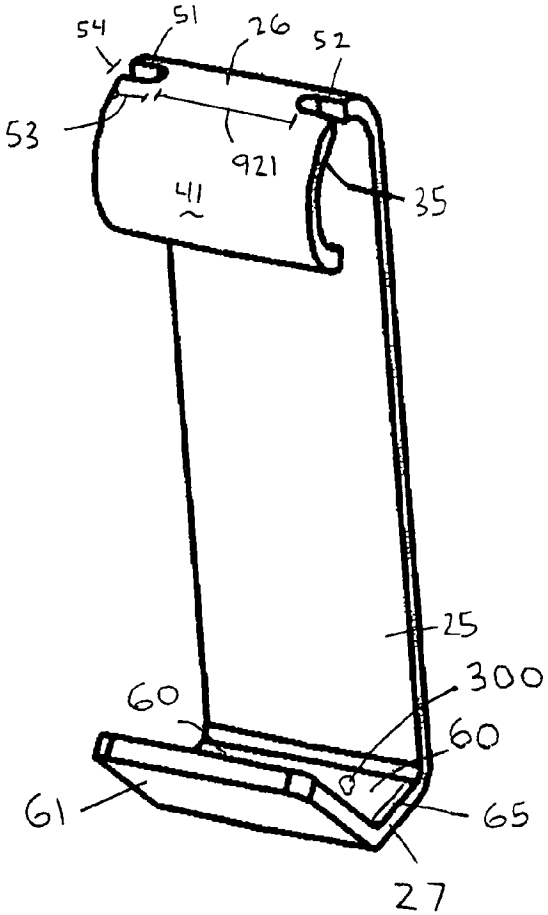
FIG. 8 illustrates a close up perspective view of the securing clamp.

Referring now to FIG. 8, the top 26 of the two support clamps 25 may each have a first slit 51 and a second slit 52. The first slit 51 may be located at the first side 30 of the top 26 of the support clamps 25 and the second slit 52 may be located at the second side 31 of the top 26 of the two support clamps 25. The first and second slit 51, 52 may each have a length 53 and a width 54. The slits 51 and 52 may run along the same planar axis and may be substantially similar to one another, but in a mirror orientation. The width 54 of the slits 51 and 52 may be slightly greater than the width 55 of the securing loops 15 such that the slits 51, 52 may fit snugly around a portion of the securing loop 15 while the device 1 is in use. As a result, the two securing clamps 25 are prevented from rotating once the portion of the securing loop 15 is located at least partly within the second slit 52 of each securing clamp 25.

The bottom 27 of the two securing clamps 25 may each have a generally flat portion 60 and an upwardly curving portion 61. In use, the generally flat portion 60 may be largely parallel with respect to the ceiling 39 and may have a width 65 which may be slightly greater than a diameter 250 (FIG. 2*b*) of a hanging bar 200 (as will be described below). As a result, the hanging bar 200 may rest on the generally flat portion 60 of the two securing clamps 25 (between the front 28 and the upwardly curving portion 61) while the device 1 is in use. More specifically, the hanging bar 200 may temporarily rest on the generally flat portion 60 of the two securing clamps 25 and remain there by, for example, gravity. In an embodiment, a temporary adhesive material 300 may be present on the generally flat portion 60 of the two securing clamps 25 to reduce or prevent movement of the hanging bar 200 while the device 1 is in use. Further, in an alternative embodiment, a pad 301 (FIG. 2*a*) may be present on the generally flat portion 60 of the two securing clamps 25 to reduce or prevent movement of the hanging bar 200 while the device 1 is in use.

The length 5 of the main support rod 2 and a length 823 (FIG. 2*b*) of the hanging bar 200 may be largely identical. In use, the main support rod 2 and the hanging bar 200 may be substantially parallel with respect to each other while hanging vertically from the ceiling 39, and wherein the hanging bar 200 is locate directly below the main support rod 2 of the device 1.

Figure 3:
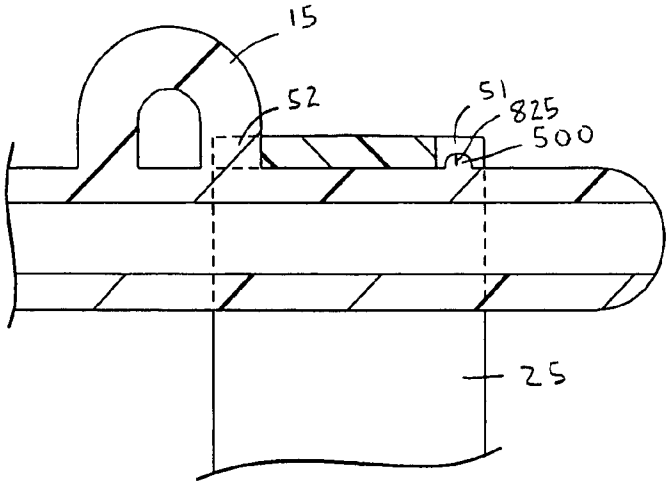
FIG. 3 illustrates a front cross-section view of the distal end of the main support rod.

Referring now to FIGS. 2 and 3, a locking bump 500 may be located on the top of the main support rod 2. The locking bump 500 may have a width 824 (FIG. 2*a*) and a height 825 (FIG. 3). The securing clamps 25 are slid over the ends 3, 4 of the main support rod 2 and the second slit 52 of the securing clamps 25 receive the portion of the securing loop 15 while the first slit 51 receives a portion of the locking bump 500 and prevents further movement of the securing clamps 25 with respect to the main support rod 2. More specifically, a distance 921 (FIG. 8) between the first slit 51 and second slit 52 is largely identical to a distance 922 (FIG. 2*a*) between the securing loop 15 and the locking bump 500 such that the securing clamps 25 lock onto the main support rod 2 between the securing loop 15 and the locking bump 500 by, for example, friction.

Figure 4:
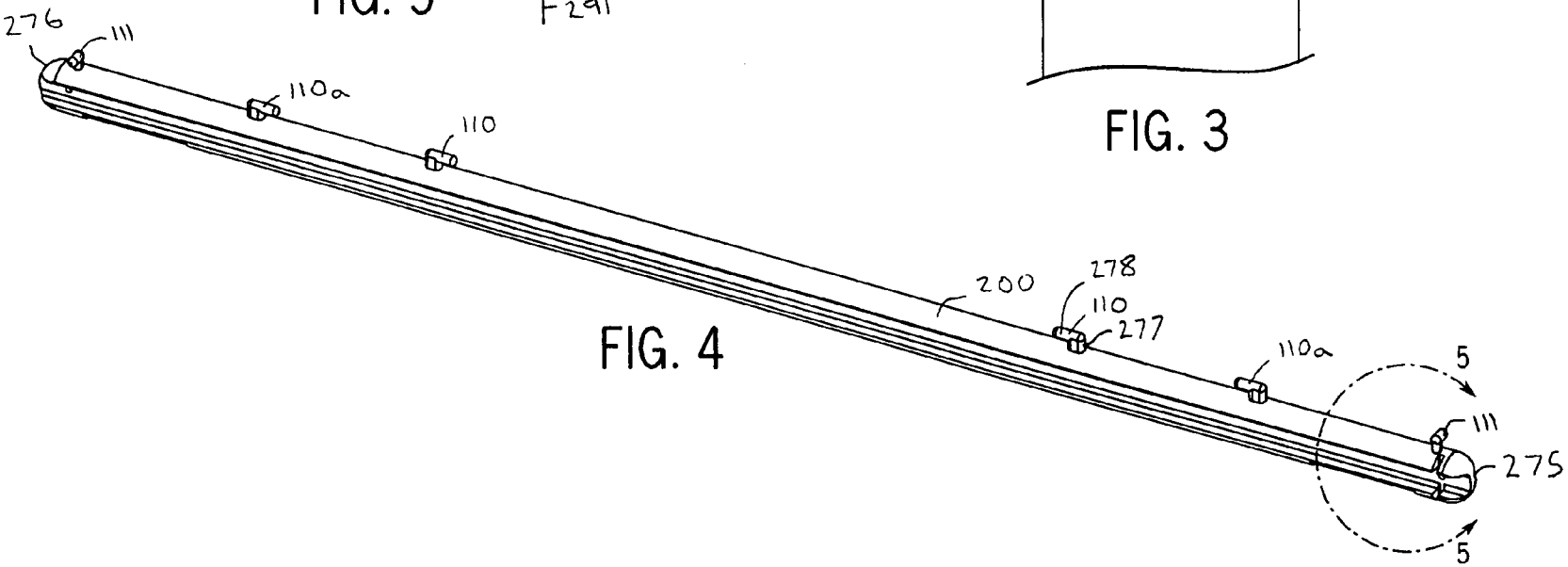
FIG. 4 illustrates a front perspective view of the hanging bar of the sign hanging device.

Referring now to FIG. 4, the hanging bar 200 may have a first end 275, a second end 276 and a plurality of pegs 110. Although FIG. 4 illustrates four pegs 110, it should be noted that any number of pegs 110 may be used depending on the desired function of the device 1. The plurality of pegs 110 may be evenly divided into two groups, those near the first end 275 of the hanging bar 200 and those at the second end 276 of the hanging bar 200.

The plurality of pegs 100 may extend upward from the hanging bar 200 (toward the ceiling 39) and may have a main shaft portion 277 and a hook portion 278. The main shaft portion 277 may extend substantially perpendicular with respect to the hanging bar 200 while the hook portion 278 extends perpendicular to the main shaft portion 277 (and therein parallel to the hanging bar 200). The hook portion 278 of the plurality of pegs 100 always extends from the main shaft portion 277 inward, toward the center of the hanging bar 200.

Figure 5:
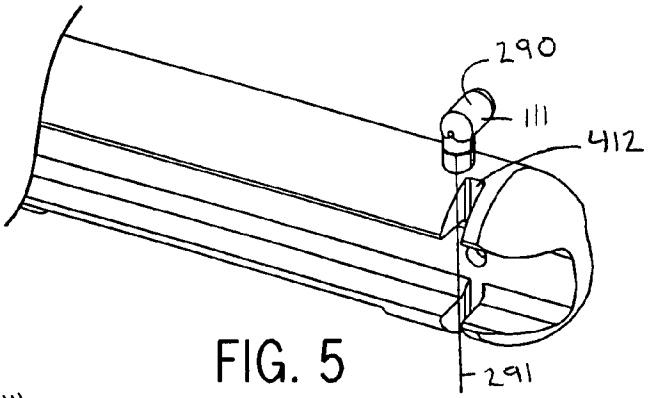
FIG. 5 illustrates a front perspective view of the distal end of the hanging bar.

Near the first end 275 and second end 276 of the hanging bar 200 (between the very distal end of the hanging bar 200 and the innermost pegs 110*a*) may be an alignment peg 111. The alignment peg 111 may largely resemble the plurality of pegs 110 of the hanging bar 200 except that the hook portion 278 of the plurality of pegs 110 face inward, toward the center of the hanging bar 200 whereas a hook portion 290 (FIG. 5) of the alignment pegs 111 extend perpendicular with respect to the hanging bar 200.

A sign wire 291 (FIGS. 1 and 5) may be secured around (or attached to) each of the alignment pegs 111 (the device 1 generally having two sign wires 291). The sign wire 291 may extend downward (away from the ceiling 39) and may be secured directly to the retain sign 100. If the user wishes to use the entire length of the sign wire 291 (for example in a building with very high ceilings 39) the sign wire 291 extends directly down from the alignment pegs 111, through a slit 412 in the hanging bar 200 (as described below) straight to the retail sign 100. If the length of the sign wire 291 is too long, the user may run the sign wire 291 first parallel toward the center of the hanging bar 200 instead of directly down the slit 412 toward the retail sign 100.

More specifically, if the ceiling 39 is low (or the user wishes to hang the retail sign 100 very high) the user needs to reduce the length of the sign wire 291 from the hanging bar 200 to the retail sign 100. To accomplish this, the user first takes the sign wire 291 and runs it parallel and inward toward the center of the hanging bar 200. If only a small portion of the sign wire 291 needs to be reduced, the user may wrap the sign wire 291 around the main shaft portion 277 of the closest peg 110*a* to the end 275, 276 of the hanging bar 200 and back toward the alignment peg 111. FIG. 1 illustrates the sign wire 291 being wrapped around the first of the plurality of pegs 110*a*. From there, the sign wire 291 extends back toward the alignment peg 111 and then downward through the slit 412 of the hanging bar 200 and finally to the retail sign 100. As a result, the total distance between the hanging bar 200 and a top 769 of the retail sign 100 is reduced by essentially twice the distance of the distance between the peg 110*a* and the alignment peg 111 (since the sign wire 291 doubles back around the peg 110). The hook portion 278 of the peg 110 may prevent the sign wire 291 from sliding or otherwise falling off the peg 110. As a result, the location of the retail sign 100 may be moved up or down with respect to the ceiling 39 while the main support rod 2 and the hanging bar 200 both remain in a fixed position with respect to the ceiling 39.

Figure 7:
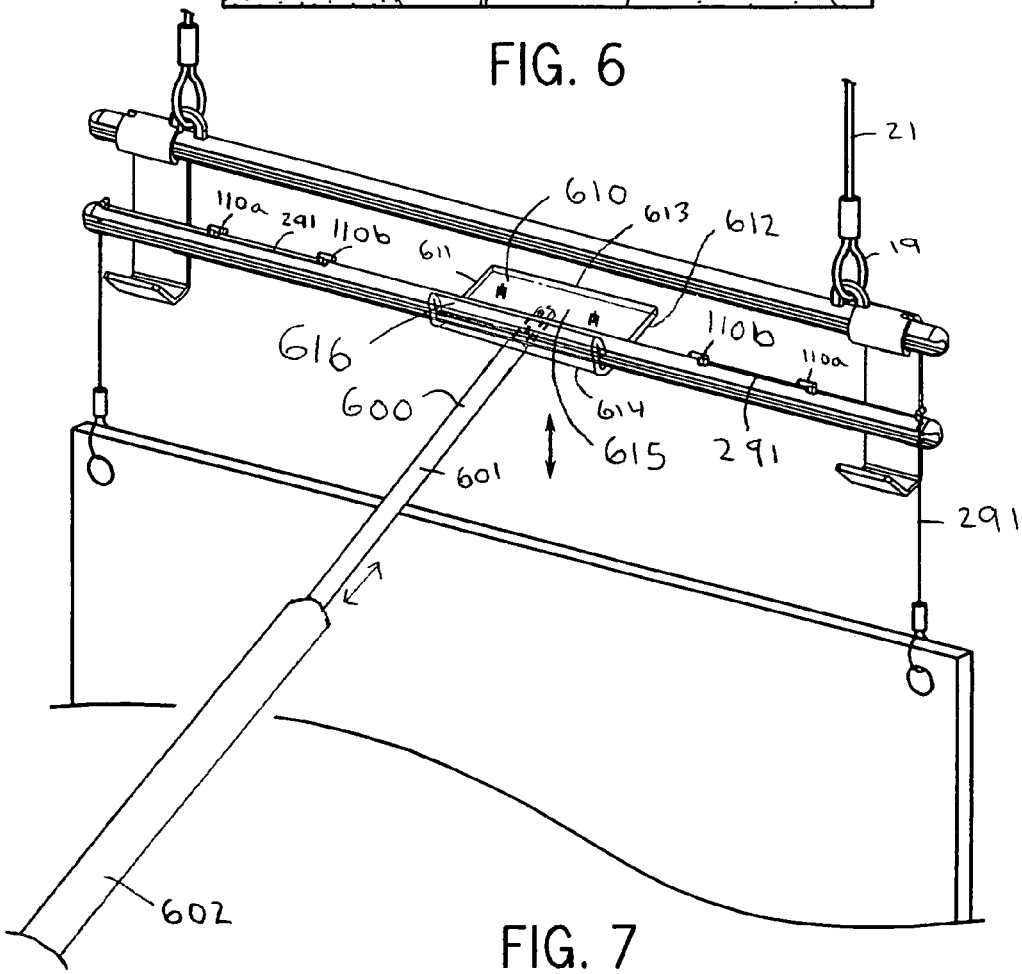
FIG. 7 illustrates a front perspective view of the hanging bar being placed on the support clamps.

If the user needs to retract a greater length of the sign wire 291 (for example if the ceiling 39 is very low), the user may elect to use a peg 110*b* farther away from the ends 275, 276 of the hanging bar 200 (FIG. 7). The user then repeats the process of using a peg 110*b* on the opposite end (275 or 276) of the hanging bar 200 so as the two sign wires 291 mirror each other in location and orientation.

As stated above, the plurality of pegs 110 may be located at increasingly greater distances from the ends 275, 276 of the hanging bar 200. When pegs 110 are used to wrap the sign wire 291 which are farther from the ends 275, 276 of the hanging bar 200, the more the sign wire 291 must be used to reach these pegs 110 and therefore, the shorter the total distance 837 (FIG. 1) between the top 769 of the retail sign 100 and the hanging bar 200. As a result, the retail sign 100 will hang closer to the ceiling 39 when a peg 110*b* is chosen which is located father away from the ends 275, 276 of the hanging bar 200 then compared to a peg 110*a* used which is closer to the ends 275, 276 of the hanging bar 200. In use, a user should select a consistent location for the pegs 110. More specifically, if a user selects, for example, the first peg 110*a* on one end 275 of the hanging bar 200 and, for example, a second peg 110*b* on the opposite end 276 of the hanging bar 200, the length of the sign wire 291 hanging down will not be uniform and the retail sign 100 will not be level.

The slit 412 (FIG. 5) on the first end 275 and second end 276 of the hanging bar 200 may create a channel allowing the sign wire 291 to hang directly downward from the hanging bar 200 in a predetermined position. When the sign wire 291 extends through the slit 412 on the hanging bar 200, the hanging bar 200 may be restricted from moving or rotating as a result of the weight of the retail sign 200 pulling the sign wires 291 straight down. The slit 412 may be located directly below the hook portion 290 of the alignment peg 111 so that the sign wire 291 passes from the alignment peg 111 directly down through the slit 412 and to the retail sign 100 or (if the plurality of pegs 110 are used to raise the height of the retail sign 100) the sign wire 291 may wrap around one of the pegs 110, then partially around the alignment peg 111 and finally through the slit 412 to the retail sign 100.

In an embodiment, the slit 412 may be present on and may run through approximately half of the diameter 250 of the hanging bar 200; therein creating a channel through the hanging bar 200 for the sign wire 291 to pass through. If the user elects to use the plurality of pegs 110 to shorten the distance 837 between the retail sign 100 and the hanging bar 200, the user should first wrap the sign wire 291 around the shaft 277 of the alignment peg 111 opposite the side of the hanging bar 200 having the slit 412 so as to prevent the sign wire 291 from sliding out of the slit 412 accidentally.

Figure 6:
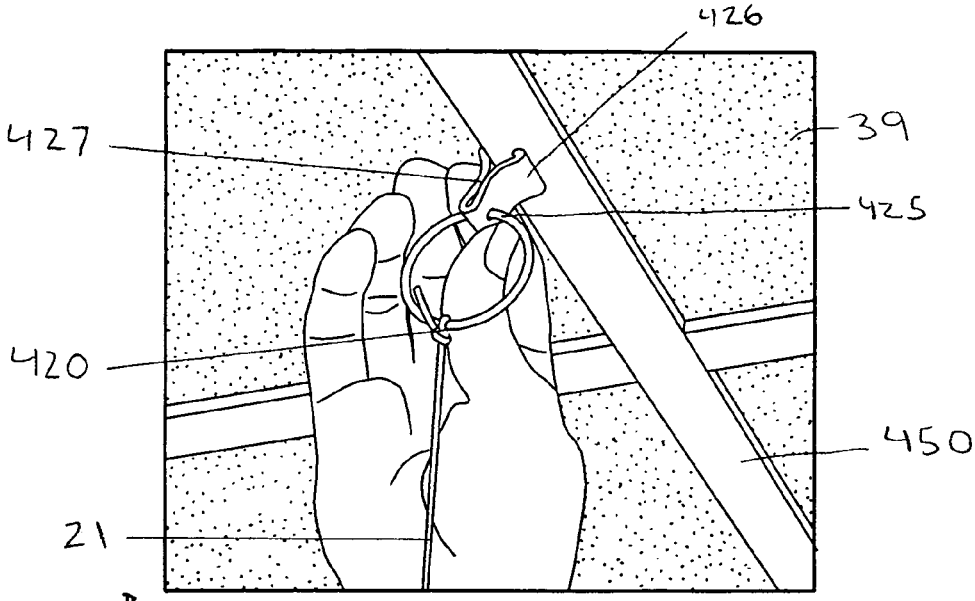
FIG. 6 illustrates the clamp ring of the device being attached to a ceiling.

Referring now to FIG. 6, a clamp ring 425 may be provided at the first end 420 of the main support wire 21. The clamp ring 425 may have a first side 426 and a second side 427. The first side 426 of the clamp ring 425 may grasp a side of a ceiling beam 450 while the second side 427 of the clamp ring 425 grasps the opposite side of the ceiling beam 450. Once the clamp ring 425 is secured to the ceiling beam 450, the main support wires 21 may support the weight of the device 1 and the hanging retail sign 100. To install the device 1, the user clamps the clamp ring 425 of each main support wire 21 to the same or different ceiling beam(s) 450. The main support wires 21 are of identical length, therein allowing the hanging retail sign 100 to hang in a level position with respect to the ceiling 39 and floor.

Referring now to FIG. 7, an adjustable pole 600 may be used to raise and insert the hanging bar 200 onto the two securing clamps 25 of the device 1. More specifically, the adjustable pole 600 may have a first end 601 and a second end 602. A grasping mechanism 610 may be secured to the first end 601 of the adjustable pole 600. The grasping mechanism 610 may have a first side 611, a second side 612, a top 613, a bottom 614, a front 615 and a back (not visible). The front 615 of the grasping mechanism 610 may be substantially flat. The bottom 614 of the grasping mechanism 610 may have an extended lip portion 616 which extends substantially perpendicular with respect to the front 615.

In an embodiment, a user may also use a generally common retail "u-shaped" reaching pole to lift the hanging bar 200 into place on the securing clamps 25 (or to remove the same). As a result of using the adjustable pole 600 or a standard "u-shaped" reaching pole, the retail sign 100 may be changed without the need for a ladder.

To hang, for example, a retail sign 100 from the ceiling 39, the user may first adjust the length of the adjustable pole 600 (in the embodiment having the first end 601 and second end 602). More specifically, the user may adjust the adjustable pole 600 by shortening or lengthening the adjustable pole 600 by telescopically moving the first end 601 inward or outward with respect to the second end 602. The user may adjust the adjustable pole 600 so as to use the device 1 in connection with ceilings 39 of various heights.

Once the proper length of the adjustable pole 600 is determined, the user places and balances the hanging bar 200 on the front 615 of the grasping mechanism 610 (the hanging bar 200 resting on the extended lip portion 616). In an embodiment, the grasping mechanism 610 has a length which is at least one-tenth the length of the hanging bar 200 so as the user may easily balance the hanging bar 200 on the grasping mechanism 610 during the installation and removal of the hanging bar 200 from the securing clamps 25.

To change a retail sign 100, the user need not remove or alter the main support rod 2, the securing clamps 25 or even the main support wires 21. Instead, the user only needs to easily remove the hanging bar 200 which rests freely on the securing clamps 25. The user may then change signs 100 and/or alter the overall height of the sign 100 with respect to the ceiling 39.

Although embodiments of the invention are shown and described therein, it should be understood that various changes and modifications to the presently preferred embodiments will be apparent to those skilled in the art. Such changes and modifications may be made without departing from the spirit and scope of the invention and without diminishing its attendant advantages.

I claim:

1. An adjustable sign frame for hanging a sign from a ceiling comprising:

a main support rod having a first end and a second end wherein the main support rod runs parallel with respect to the ceiling;

a first securing loop secured to the main support rod wherein the first securing loop is secured near the first end of the main support rod and a second securing loop secured to the main support rod wherein the second securing loop is secured near the second end of the support rod;

a first support wire attached to the first securing loop of the main support rod and a second support wire attached to the second securing loop of the main support rod wherein the first and second support wire are attached to the ceiling;

a first support clamp having a first end and a second end wherein the first support clamp is removably secured to the main support rod near the first end of the main support rod;

a second support clamp having a first end and a second end wherein the second support clamp is removably secured to the main support rod near the second end of the main support rod wherein the first and second support clamp each have a top, a bottom, a front, a back and wherein the tops of the support clamps are secured to the main support rod and wherein the bottoms of the support clamps hang down from the main support rod and further wherein the bottoms of the support clamps have has an extended planar surface which is substantially parallel with respect to the ceiling;

wherein the first and second support clamp each have an elongated first slit and an elongated second slit wherein the elongated first slit is located at the first end of the support clamp and wherein the elongated second slit is located at the second end of the support clamp and wherein all the slits are located at the top of the first clamp and the top of the second clamp and wherein the elongated first slit and the elongated second slit each have a width and wherein the width of the elongated first slit and the elongated second slit run along the same planar surface and wherein the elongated first slit or the elongated second slit of the first support clamp and wherein the elongated first slit or the elongated second slit of the second support clamp fit snugly around a portion of the securing loops of the main support rod and wherein the portion of the securing loops within the elongated first slit and elongated second slit prevent the first clamp and second clamp from rotating with respect to the main support rod; and a hanging bar having a sign attached thereto wherein the hanging bar removably rests on the extended planar surface of the bottom of the support clamps by gravity.

2. The adjustable sign frame of claim 1 further comprising:

a wire having a first end and a second end wherein the first end is permanently secured to the hanging bar wherein the second end of the wire is connected to the sign; and a plurality of pegs located on the hanging bar wherein the plurality of pegs each have a shaft which extends outward from the hanging bar and wherein the wire secured to the sign is at least partially wrapped around one of the plurality of pegs between the first end and second end of the wire.

3. The adjustable sign frame of claim 2 further comprising:

an extended hook portion attached to the shaft of the plurality of pegs at approximately ninety degrees with respect to the shaft of the plurality of pegs wherein the extended hook portion prevents the wire from sliding off the shaft of the plurality of pegs.

4. The adjustable sign frame of claim 2 further comprising:

a slit creating an opening channel located on the hanging bar wherein the wire passes through the slit of the hanging bar and is attached to the sign.

* * * * *